United States Patent [19]

Johnson

[11] 4,417,359

[45] Nov. 29, 1983

[54] KARATE GLOVE

[76] Inventor: Johnnie L. Johnson, 1455 W. 94th St., Los Angeles, Calif. 90047

[21] Appl. No.: 46,183

[22] Filed: Jun. 6, 1979

Related U.S. Application Data

[63] Continuation-in-part of Ser. No. 792,135, Apr. 29, 1977, abandoned.

[51] Int. Cl.[3] ..... A41D 19/00

[52] U.S. Cl. ..... 2/161 A

[58] Field of Search ..... 2/161 A, 18, 2, 19, 2/161 R, 159, 162

[56] References Cited

U.S. PATENT DOCUMENTS 3,903,546 9/1975 Rhee ..... 2/16

FOREIGN PATENT DOCUMENTS 1861 of 1907 United Kingdom ..... 2/18

*Primary Examiner*—Doris L. Troutman

*Attorney, Agent, or Firm*—Lyon & Lyon

[57] ABSTRACT

Disclosed herein is a durable protective glove for use in the martial arts such as karate. The glove fits completely about the wearer's hand and includes an inner glove defining individual finger portions and having a padded palm area, a heavily padded backing extending over and secured to the back side of the inner glove, and means for maintaining the finger portions of the inner glove in a fixed lateral disposition while providing freedom of movement of the finger portions inwardly from the backing for gripping an opponent. Reinforcing means are provided for the thumb portion of the glove to prevent dislocation thereof while allowing the thumb to be readily folded under the hand palm for executing various movements and techniques.

4 Claims, 8 Drawing Figures

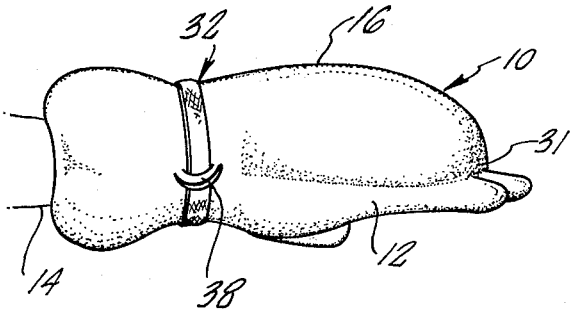
FIG. 1
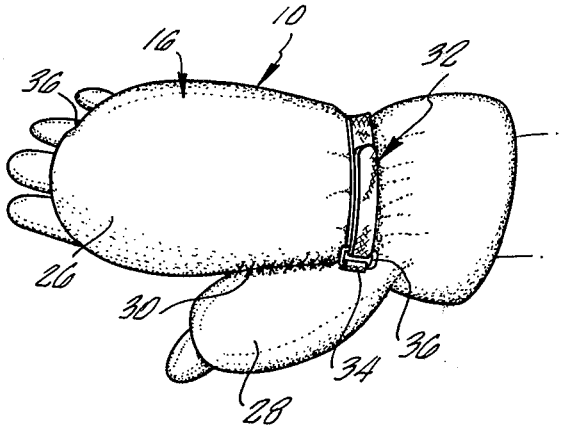
FIG. 2
FIG. 3
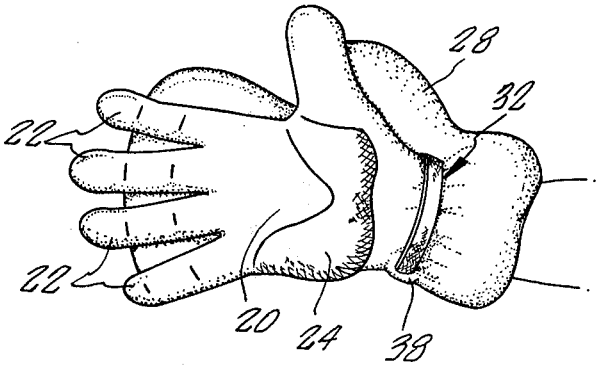
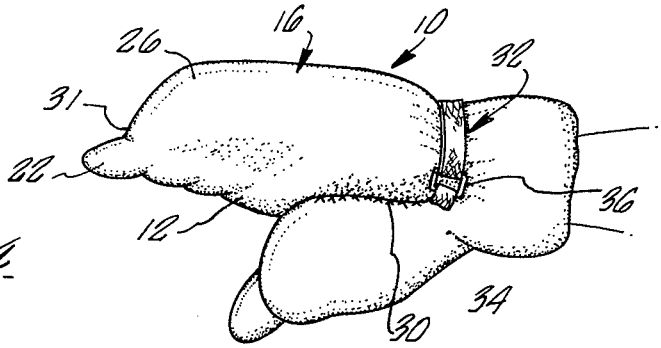
FIG. 4

KARATE GLOVE

This application is a continuation-in-part of a parent application Ser. No. 792,135, filed Apr. 29, 1977, abandoned, for a KARATE GLOVE.

BACKGROUND OF THE INVENTION

The present invention relates to a protective glove adapted to be worn on the hands when participating in the martial arts such as karate, kung-fu, etc. As is well-known, the art of karate, in particular, is a method of defending oneself by striking sensitive areas on an attacker's body with the hands, elbows, knees or feet. During training in the art as well as in organized competition, the hands and fingers can be badly bruised and injured from the extensive use of the palm, back and sides of the hand. In addition, an opponent in competition can be easily injured if a blow is not stopped short of his body. Accordingly, various protective gloves have been developed for protecting against injury to the hand and the opponent. Examples of such gloves are found in U.S. Pat. Nos. 3,903,546 and 3,855,633.

While the protective gloves heretofore developed have proved useful in reducing injury, they have several shortcomings. Firstly, such devices are too inflexible and overly restrict the movement of the hand. In exercising different techniques, the hand is often opened for check blocking or executing a palmhand, closed for a punch and rigid for executing chops or ridgehands. The inflexible nature of those gloves restricts the proper execution of these different techniques. Secondly, such gloves are generally quite cumbersome in their incorporation of a bulky outer casing which extends over the front portion of the hand. This outer casing can quickly shift upon impact resulting in a wrist sprain and completely eliminates the use of the fingers in attempting to flip or sweep an opponent down. Other shortcomings of such gloves include their failure to adequately protect the thumb against accidential dislocation while allowing relative freedom of movement of the thumb for the execution of certain blows and their prevalent use of gripping straps or loops which fit about the wearer's fingers and not only restrict the use of the fingers but inevitably lead to tearing or other damage of the glove within a short period of time. Accordingly, it would be highly desirable to provide a more durable protective glove which both adequately protects the wearer's hand and the opponent while providing the necessary flexibility to allow the wearer to execute the different techniques employed in the martial arts.

SUMMARY OF THE INVENTION

Briefly, the protective glove of the present invention includes a protective covering for the entire hand, a padded palm area and a heavily padded backing which extends over the glove finger portions and through means secured thereto, greatly restrict lateral movement of the finger portions while allowing the finger portions sufficient freedom of inward movement for easily grabbing an opponent. Reinforcement is provided for the thumb portion of the glove to prevent dislocation of the wearer's thumb while allowing the thumb portion to be freely folded under the palm hand for executing various blows and techniques.

It is the principal object of the present invention to provide a protective glove for use in the martial arts which is superior to those gloves heretofore available.

It is another object of the present invention to provide a protective glove for use in the martial arts which both protects a player's hand and an opponent while allowing freedom of movement of the hand for executing the various blows and techniques.

It is a further object of the present invention to provide a protective hand glove for use in the martial arts which is highly durable.

It is yet another object of the present invention to provide a protective hand glove for use in the martial arts which allows freedom of movement of the extended ends of the wearer's fingers for grabbing an opponent while restricting lateral movement of the first and second phalanxs of the fingers for reducing injury thereto.

These and other objects and advantages of the present invention will become apparent from the following detailed description taken in conjunction with the accompanying drawings.

IN THE DRAWINGS

FIG. 1 is a side view of the protective glove of the present invention disposed about a wearer's hand.

FIG. 2 is a plan view of the protective glove of the present invention.

FIG. 3 is a bottom view of the protective glove of the present invention.

FIG. 4 is a side view of the protective glove of the present invention illustrating the thumb portion thereof.

DESCRIPTION OF THE FIRST EMBODIMENT

Figure 5:
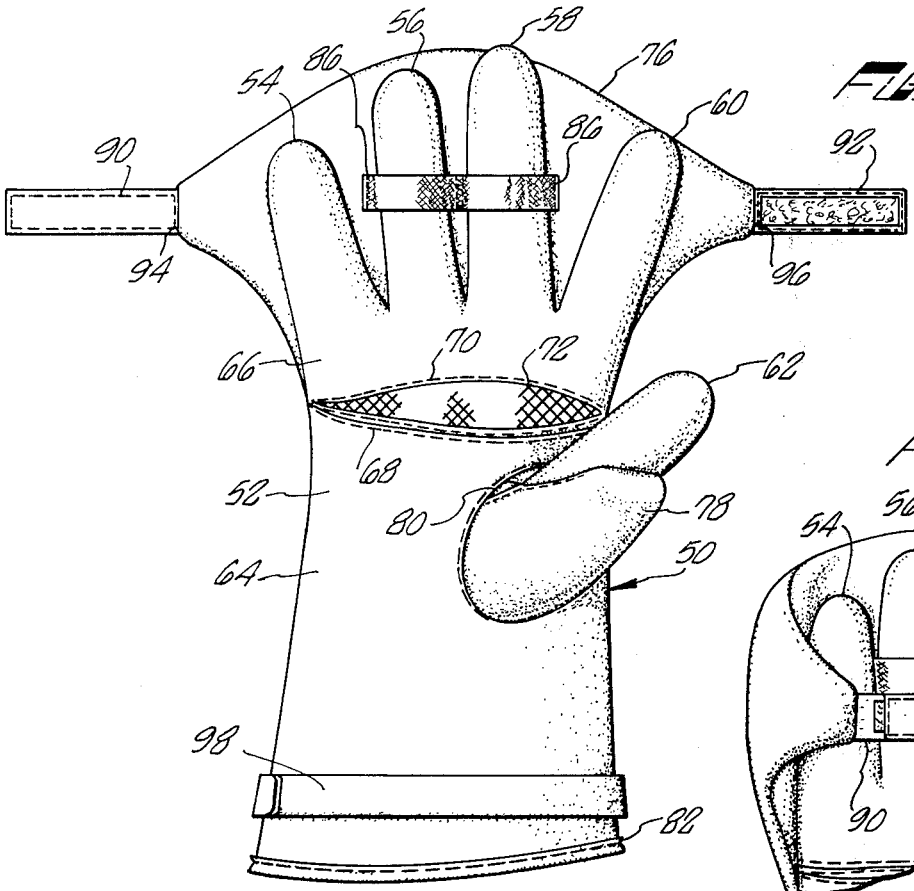
FIG. 5 is a view of the underside of a second embodiment of the protective glove of the present invention illustrating the finger portion restraining means.

The first embodiment of the protective glove 10 of the present invention is illustrated in FIGS. 1 through 4 and is preferably constructed of leather for durability and is comprised of a main glove portion 12 which is adapted to fit over the wearer's hand 14 and a heavily padded flexible backing 16 which can be integrally formed with the main glove portion 12 as illustrated in the drawings or secured to the backside of the main portion 12 by stitching or other suitable attachment means. The main glove portion 12 also includes a palm portion 20 and fingers 22. Flexible light padding 24 of about $\frac{1}{8}$ inch in thickness is disposed about the lower and side portions of the palm portion 20 of the glove, as seen in FIG. 3, to protect the palm of the wearer's hand while executing check blocks, palmhands or other blows utilizing the palm of the hand.

The flexible backing 16 of the glove 10 includes hand and thumb portions 26 and 28 respectively. The hand portion 26 can be of any desired thickness but preferably it is about two inches thick to adequately protect both the backside of the hand and the body of an opponent. The thumb portion 28 need only be about one inch in thickness to provide adequate protection. A double-stitch seam 30 extends between and joins the hand and thumb portions 26 and 28 of backing 16 to prevent the wearer's thumb from being bent backwardly of the fingers and dislocated during training or competition. This seam also allows complete flexibility of the thumb so that the thumb can readily be disposed under the palm portion 20 of the glove for executing chops and ridgehands.

While each of the fingers 22 of the main portion of the glove are completely independent, the forward edge 31 of the padded backing 16 extends over and joins the fingers 22 along a line approximately over the distal inter-phalangeal joints thereby preventing relative lateral movement of the fingers and substantially reducing the chance of breakage while freeing the ends of the fingers for use in grabbing an opponent during competition.

Finally, the glove 10 is provided with a strap fastening member 32 for drawing the open end of the glove tightly about the wearer's wrist to prevent the glove from being pulled from the wearer's hand during competition. In the preferred embodiment of the glove, the strap 32 is of the hook and pile fastening type marketed under the name Velcro and is secured at one end 34 thereof to a rigid loop 36. The strap extends through a loop 38 in the underside of the main glove portion 12 about the padded backing and back through loop 36.

DESCRIPTION OF THE SECOND EMBODIMENT

The second embodiment of the protective glove 50 of the present invention is illustrated in FIGS. 5 through 8 and as the first embodiment, is preferably constructed of leather and is comprised of an inner glove 52 defining finger portions 54, 56, 58 and 60 and thumb portion 62. The inner glove has a padded palm area 64 and separates the palm area from the forward finger area 66 at stitching 68 and 70. The palm and finger areas are joined together by a webbing 72 which both allows the glove to breath and provides increased flexibility for the finger area 64 for use in grabbing opponent. The padding for the palm area 62 of the glove is similar to that found in the first embodiment to protect the palm of the wearer's hand while executing check blocks, palmhands or other blows utilizing the palm of the hand.

The flexible backing 76 of the glove 50 can be of any desired thickness but preferably about 1 inch thick to adequately protect both the backside of the hand and the body of the opponent. The thumb portion 78 of backing 76 in this embodiment is only about ¼ inch in thickness to provide adequate protection. As with the first embodiment, a double-stitched seam 80 extends between and joins the thumb portion 78 to the palmside of the glove to prevent the wearer's thumb from being bent backwardly of the fingers and dislocated during training or competition. This seam also allows complete flexibility of the thumb so that the thumb can be readily disposed under the palm area 62 of the glove for executing chops and ridgehands. As seen in FIGS. 5 through 8, the backing 76 of the second embodiment extends over the finger portion of the inner glove and is secured to the inner glove rearwardly of the fingers at any desired location. In the glove illustrated in the drawings, the backing is secured to the inner glove at the rear seam 82.

Figure 6:
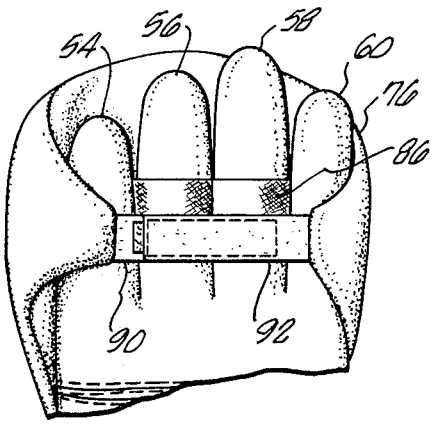
FIG. 6 is a partial view of the underside of a second embodiment of the protective glove of the present invention illustrating the finger portion restraining means in the closed position.

To restrain the fingers from lateral movement and thereby prevent dislocation of the wearer's fingers during training or competition, the inner surface 84 of the flexible backing 76 is provided with loops 86 which are stitched onto the glove as illustrated in FIG. 5. The loops 86 are positioned on the inner side of the backing such that they encircle the second and third finger areas 56 and 58 rearwardly of the distal phalangeal joints to increase the flexibility of the wearer's hand for gripping an opponent. Finger portions 54 and 60 are restrained from lateral movement by straps 90 and 92 which are secured to the lateral side of the backing 76 at 94 and 96. In the preferred construction, straps 90 and 92 have hook and pile fastener material, such as that marketed under the name Velcro, secured thereto as seen in FIG. 5 so that they can easily be drawn about the finger portion of the glove and secured together as seen in FIG. 6.

Figure 7:
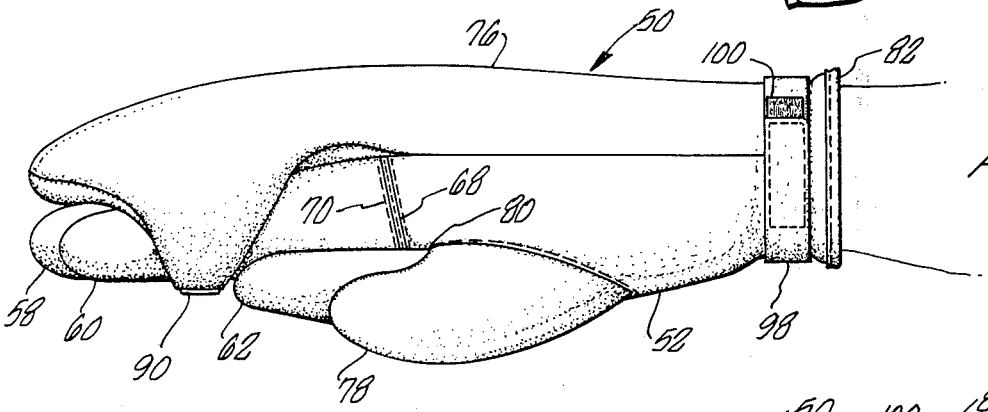
FIG. 7 is a side view of the second embodiment of the present invention disposed about a wearer's hand.
Figure 8:
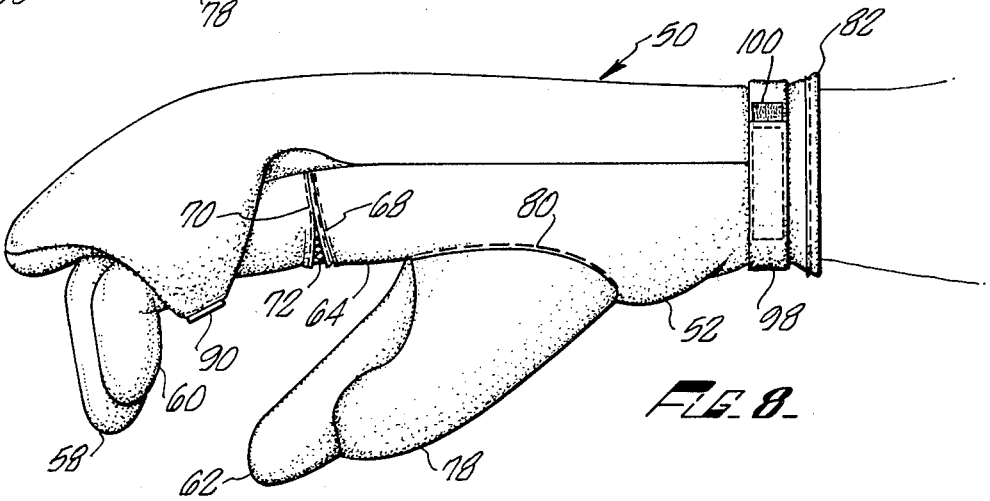
FIG. 8 is a side view of the second embodiment of the protective glove of the present invention disposed about a wearer's hand in a gripping configuration.

Finally, the glove 50 is provided with a strap fastening member 98 for drawing the open end of the glove tightly about the wearer's wrist to prevent the glove from being pulled from the wearer's hand during competition. In the preferred construction of the glove, the strap 98 also has hook and pile fastening type material 100 secured thereto and the strap 98 is secured at one end to the side of the glove portion, extended about the glove portion and fastened back upon itself through the hook and pile fastener as seen in FIGS. 7 and 8.

Various changes and modifications may be made in carrying out the present invention without departing from the spirit and scope thereof. Insofar as these changes and modifications are within the purview of the appended claims, they are to be considered as part of the present invention.

I claim:

1. A protective glove for use in the martial arts comprising an inner glove adapted to fit over the wearer's hand, said inner glove defining a palm portion, individual finger receiving portions and a thumb receiving portion, said finger receiving portions and said thumb receiving portion being closed at their extended ends; a flexible padded backing secured to and disposed over the backside of said inner glove and extending over said finger receiving portions; and means for securing said backing to said finger receiving portions at locations spaced from the closed extended ends thereof such that said finger receiving portions are restrained from relative lateral movement while the extended ends of said finger receiving areas are freely moveable from said backing to cooperate with said thumb receiving portion for gripping an opponent.

2. A protective glove for use in the martial arts comprising an inner glove adapted to fit over the wearer's hand, said inner glove defining a palm portion, individual finger receiving portions and a thumb receiving portion, said finger and thumb receiving portions being closed at their extended ends; a flexible padded backing secured to and disposed over the backside of said inner glove and extending over said finger receiving portions; and loop means carried by said backing and adapted to be disposed about said finger receiving portions rearwardly of the extended ends thereof such that said finger receiving portions are restrained from relative lateral movement while the extended ends of said finger receiving portions are freely moveable from said backing to cooperate with said thumb receiving portion for gripping an opponent.

3. A protective glove for use in the martial arts comprising an inner glove having a finger receiving portion, a palm portion and a webbing securing said finger receiving portion to said palm portion, said finger receiving portion defining individual finger receiving areas and said palm portion defining a thumb receiving area;

a flexible padded backing secured to and disposed over the backside of said inner glove, said backing extending over said finger receiving portion; a loop member secured to said backing and disposed about the inner two of said finger receiving areas for preventing relative lateral movement of said inner two finger receiving areas; and strap members extending from the lateral side of said backing and being adapted to be tightly secured together about all of said finger receiving areas for preventing relative lateral movement of the outer finger receiving areas relative to said inner two finger receiving areas disposed within said loop member thereby restraining all of said finger receiving areas from relative lateral movement while the ends of said finger receiving areas are freely movable from said backing to cooperate with said thumb receiving area for gripping an opponent.

4. The combination of claim 3 including hook and pile fasteners secured to said straps members for securing said strap members about all of said finger receiving areas and means for restricting rearward movement of said thumb receiving area from said finger receiving areas.

* * * * *